US008956130B2

(12) United States Patent
Buzit et al.

(10) Patent No.: US 8,956,130 B2
(45) Date of Patent: Feb. 17, 2015

(54) REDUNDANT SUMP PUMP SYSTEM

(75) Inventors: Sebastien Buzit, Delavan, WI (US); Richard Cameron, Delavan, WI (US)

(73) Assignee: Pentair Flow Technologies, LLC, Delavan, WI (US)

( * ) Notice: Subject to any disclaimer, the term of this patent is extended or adjusted under 35 U.S.C. 154(b) by 369 days.

(21) Appl. No.: 12/646,456

(22) Filed: Dec. 23, 2009

(65) Prior Publication Data

US 2011/0150676 A1 Jun. 23, 2011

(51) Int. Cl.

| | |
|---|---|
| ***F04B 35/04*** | (2006.01) |
| ***F04D 9/00*** | (2006.01) |
| ***F04D 13/08*** | (2006.01) |
| ***F04D 13/14*** | (2006.01) |
| ***F04D 13/06*** | (2006.01) |

(52) U.S. Cl.

CPC ..... *F04D 9/008* (2013.01); *F04D 13/08* (2013.01); *F04D 13/14* (2013.01); *F04D 13/068* (2013.01)

USPC ..... 417/423.3; 417/423.5

(58) Field of Classification Search

CPC ..... F04D 13/08; F04D 13/083; F04D 13/086; F04D 13/12; F04D 13/14; F04D 13/16; F04D 15/0218

USPC ..... 417/423.3, 423.5

See application file for complete search history.

(56) References Cited

U.S. PATENT DOCUMENTS

| | | | | |
|---|---|---|---|---|
| 2,810,345 | A | * | 10/1957 | Englesson ..... 417/338 |
| 3,256,828 | A | * | 6/1966 | Rule ..... 417/363 |
| 3,275,061 | A | | 9/1966 | Williams et al. |
| 3,296,824 | A | | 1/1967 | Rohrs et al. |
| 3,431,940 | A | | 3/1969 | Hanley |
| RE27,148 | E | | 6/1971 | Schaub |
| 3,627,239 | A | | 12/1971 | Hull, Jr. |
| 3,992,894 | A | | 11/1976 | Antonetti et al. |
| 4,014,475 | A | | 3/1977 | Grace et al. |
| 4,218,195 | A | * | 8/1980 | Shure ..... 417/411 |
| 4,222,711 | A | * | 9/1980 | Mayer ..... 417/7 |
| D268,412 | S | | 3/1983 | Davis et al. |
| 4,559,963 | A | | 12/1985 | Sugisawa et al. |
| 4,611,578 | A | | 9/1986 | Heimes |
| 4,652,802 | A | | 3/1987 | Johnston |
| 4,676,454 | A | | 6/1987 | Zompolas et al. |
| 4,702,843 | A | | 10/1987 | Oswald et al. |
| 4,738,584 | A | * | 4/1988 | Price ..... 415/60 |
| 4,799,864 | A | | 1/1989 | Hockley |
| 4,886,989 | A | | 12/1989 | Britt |
| 4,897,022 | A | | 1/1990 | Hudson |
| 4,919,343 | A | | 4/1990 | Van Luik, Jr. et al. |
| 5,139,397 | A | * | 8/1992 | Strelow ..... 417/423.5 |
| 5,173,957 | A | | 12/1992 | Bergano et al. |
| 5,477,882 | A | | 12/1995 | Duthie |
| 5,630,437 | A | * | 5/1997 | Dries et al. ..... 134/186 |
| 5,806,111 | A | | 9/1998 | Helmbrock et al. |
| 5,907,473 | A | | 5/1999 | Przilas et al. |

(Continued)

*Primary Examiner* — Charles Freay
(74) *Attorney, Agent, or Firm* — Quarles & Brady LLP

(57) ABSTRACT

Embodiments of the invention provide a sump pump system that pumps fluid. The system can include a base with one or more inlets and one or more outlet. The system can also include a first cartridge coupled to the base and removable from the base. The first cartridge can include a first electric motor. The system can further include a second cartridge coupled to the base and removable from the base. The second cartridge can include a second electric motor. The first cartridge and/or the second cartridge can be capable of operating at any given time in order to propel fluid from inlets to the outlets.

21 Claims, 9 Drawing Sheets

(56) References Cited

U.S. PATENT DOCUMENTS

| | | | | |
|---|---|---|---|---|
| 5,927,955 | A * | 7/1999 | Janesky | 417/423.3 |
| 5,985,139 | A | 11/1999 | Zoeller | |
| 6,308,924 | B1 * | 10/2001 | Janesky | 248/346.01 |
| 6,328,543 | B1 | 12/2001 | Benecke | |
| 6,364,620 | B1 * | 4/2002 | Fletcher et al. | 417/36 |
| 6,375,388 | B1 | 4/2002 | Zoeller et al. | |
| 6,375,430 | B1 * | 4/2002 | Eckert et al. | 417/40 |
| 6,408,828 | B1 | 6/2002 | Wheeler | |
| 6,419,454 | B1 | 7/2002 | Christiansen | |
| 6,461,114 | B1 * | 10/2002 | Lin | 417/40 |
| 6,675,989 | B1 * | 1/2004 | Ritter et al. | 222/61 |
| 6,715,994 | B2 * | 4/2004 | Patel et al. | 417/12 |
| 6,752,600 | B2 | 6/2004 | Worthington | |
| 6,758,231 | B1 | 7/2004 | Lochtefeld et al. | |
| D500,770 | S | 1/2005 | Pohler | |
| 6,854,479 | B2 | 2/2005 | Harwood | |
| 6,899,532 | B2 | 5/2005 | Eddy et al. | |
| 6,957,662 | B2 | 10/2005 | Lochtefeld et al. | |
| 7,040,994 | B2 | 5/2006 | Lochtefeld et al. | |
| D523,517 | S | 6/2006 | Flick | |
| 7,088,585 | B2 | 8/2006 | Chu et al. | |
| 7,100,632 | B2 | 9/2006 | Harwood | |
| 7,203,976 | B1 | 4/2007 | Weller et al. | |
| 7,207,500 | B2 | 4/2007 | Hudson et al. | |
| 7,389,787 | B2 | 6/2008 | Means et al. | |
| 2003/0170077 | A1 | 9/2003 | Herd et al. | |
| 2005/0166961 | A1 | 8/2005 | Means et al. | |
| 2006/0125332 | A1 | 6/2006 | Tolle et al. | |
| 2006/0201869 | A1 * | 9/2006 | Collins et al. | 210/435 |
| 2008/0017472 | A1 | 1/2008 | Redelman et al. | |

* cited by examiner

REDUNDANT SUMP PUMP SYSTEM

BACKGROUND

Sump pumps are typically used to extract a fluid from a basement, a container, or a vessel, such as water from a basement of a house or water from a bilge of a boat. Typically, the sump pump is activated based on a fluid level in the basement, container, or vessel.

In order to prevent flooding, the sump pump must be able to extract the fluid from the basement, container, or vessel at a higher flow rate than the fluid entering the vessel. The sump pump generally must be designed for the highest expected incoming flow rate into the basement, container, or vessel. As a result, conventional sump pumps include a relatively powerful motor that often requires a higher power consumption than may be necessary. With conventional sump pumps, if the motor fails, there is no backup option and flooding occurs.

SUMMARY

Some embodiments of the invention a sump pump system that pumps fluid. The system can include a base with one or more inlets and one or more outlets. The system can also include a first cartridge coupled to the base and removable from the base. The first cartridge can include a first electric motor. The system can further include a second cartridge coupled to the base and removable from the base. The second cartridge can include a second electric motor. The first cartridge and/or the second cartridge can be capable of operating at any given time in order to propel fluid from the inlets to the outlets. In some embodiments, the sump pump system can include one or more cartridges. The cartridges can be removable from the base without removing an outlet conduit system and without interrupting electrical communication between a power supply and an electric motor in the cartridge. In some embodiments, the sump pump system can include a gasket with a flap coupled to the cartridge. The flap can at least partially cover one or more of the outlets.

DETAILED DESCRIPTION

Figure 1:
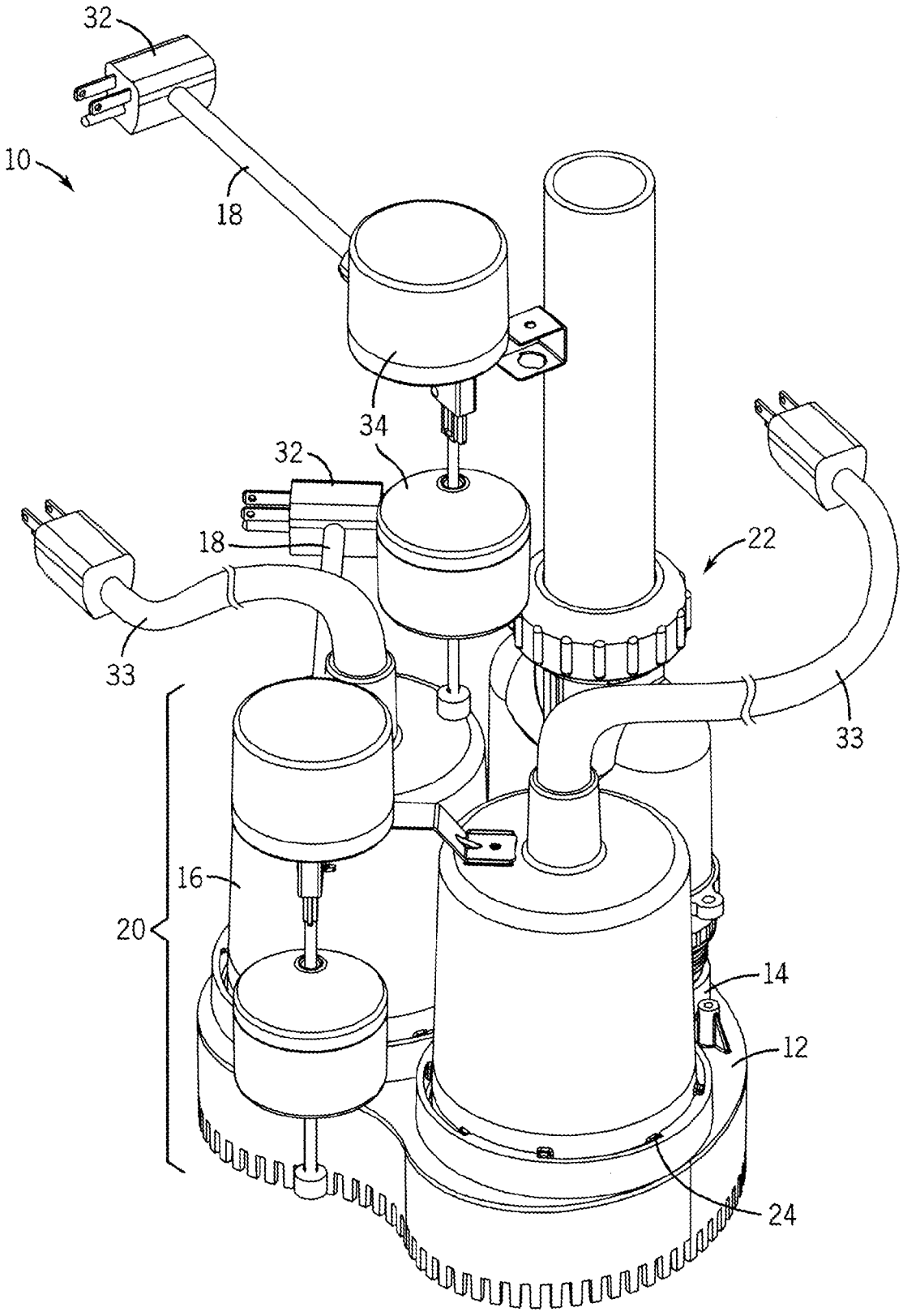
FIG. 1 is a perspective view of a sump pump system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
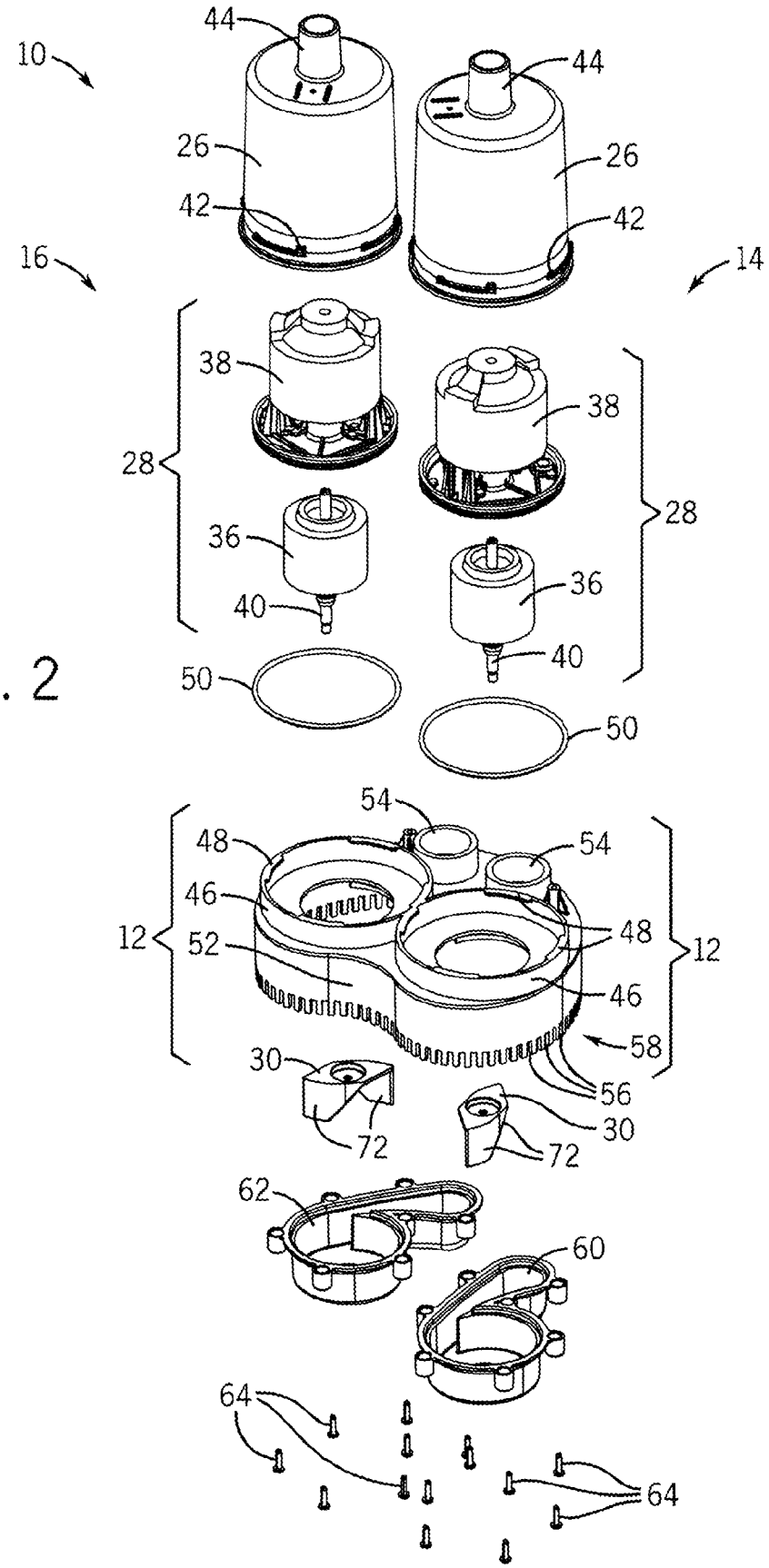
FIG. 2 is an exploded view of the sump pump system of FIG. 1.

FIG. 1 illustrates a sump pump system 10 according to one embodiment of the invention. The sump pump system 10 can include a base 12, a first cartridge 14, a second cartridge 16, a first power cord 18, a first float switch 20, and an outlet conduit system 22. In some embodiments, the first cartridge 14 and the second cartridge 16 can be coupled to the base 12 using a quick connect device 24. As shown in FIG. 2, the first cartridge 14 and the second cartridge 16 can each include a housing 26, an electric motor 28, and an impeller 30.

In some embodiments, the first power cord 18 can include a switchplug 32. The first float switch 20 can operate the switchplug 32 by selectively enabling or interrupting a current flow through the switchplug 32 depending on a position of the first float switch 20. A second power cord 33 can be coupled to the switchplug 32 and at least one of the first cartridge 14 and the second cartridge 16. The second power cord 33 can provide the current flow from the switchplug 32 to the first cartridge 14 and/or the second cartridge 16. In some embodiments, the first cartridge 14 and the second cartridge 16 have each individual power supplies. In other embodiments, the first power cord 18, the first float switch 20, and/or the second power cord 33 can provide power to both electric motors 28.

In some embodiments, the sump pump system 10 can include a second float switch 34. The second float switch 34 can include the first power cord 18 and/or the second power cord 33. In some embodiments, the first float switch 20 and/or the second float switch 34 can include a relay. The first float switch 20 can operate the first cartridge 14, while the second float switch 34 can operate the second cartridge 16. The first cartridge 14 and/or the second cartridge 16 can pump the fluid out of a basement, container, or vessel. In some embodiments, the first float switch 20 can be operated by a first fluid level in the basement, container, or vessel and the first cartridge 14 can be activated. In some embodiments, the second float switch 34 can be operated by a second fluid level to activate the second cartridge 16. In some embodiments, the second float switch 34 can be positioned above the first float switch 20 resulting in the second fluid level being higher than the first fluid level. For example, if the sump pump system 10 is used to extract water from the vessel, the first float switch 20 can be engaged by a water level inside the vessel and the first cartridge 14 can be activated to extract water from the vessel. If the first cartridge 14 fails or if the first cartridge 14 extracts a smaller flow rate than an incoming flow rate into the vessel, the water level inside the vessel will rise. If the water level engages the second float switch 34, the second cartridge 16 can be activated. As a result, the second cartridge 16 can support the pumping action of the first cartridge 14 and/or can act as a backup system for the first cartridge 14. In some embodiments, only the first cartridge 14 is activated under normal operating conditions and the second cartridge 16 is only activated during an abnormal event, such as an unusually high flow rate and/or a failure of the first cartridge 14. Once a fluid level inside the vessel has dropped below a certain threshold, the first float switch 20 and/or the second float switch 34 can disengage to shut down the respective electric motor 28.

FIG. 2 illustrates the internal components of the sump pump system 10 according to one embodiment of the invention. The electric motor 28 can include a rotor 36 and a stator 38. The rotor 36 can include a shaft 40 to which the impeller 30 can be coupled. The electric motor 28 can be enclosed by the housing 26, which can include a latch 42 and a protrusion 44. In some embodiments, the protrusion 44 can be threaded. The protrusion 44 can be used to connect the power cord 33 to the first cartridge 14 and/or the second cartridge 16. A connector (not shown) from the power cord 33 can be coupled to the protrusion 44 to supply power to the electric motor 28. The protrusion 44 can be used to make the connection watertight. In some embodiments, the threads can help prevent an accidental removal of the connector.

In some embodiments, the base 12 can include a fitting 46, which can be used to couple the housing 26 to the base 12. In some embodiments, the latch 42 can engage a ridge 48 located on the fitting 46 to form the quick connect device 24. Other embodiments can include another suitable quick connect device 24. An O-ring 50 can seal the connection between the base 12 and the housing 26 in order to substantially prevent leakage of the quick connect device 24. In some embodiments, the base 12 can further include a sidewall 52 and one or more outlets 54. The sidewall 52 can include openings 56 forming an inflow 58 into the sump pump system 10. In some embodiments, the first cartridge 14 and the second cartridge 16 can propel the fluid from the inflow 58 to the outlets 54.

As shown in FIG. 2, the sump pump system 10 can include a first collector 60 and a second collector 62 for the first cartridge 14 and the second cartridge 16, respectively. In some embodiments, the first collector 60 and the second collector 62 can be coupled to a bottom of the base 12 using screws 64. In some embodiments, the sidewall 52 can be higher than the first collector 60 and the second collector 62. The first collector 60 and the second collector 62 can direct fluid from the impeller 30 to the outlets 54. In some embodiments, the first collector 60 and the second collector 62 can help route fluid from the inflow 58 to the outlets 54.

Figure 3:
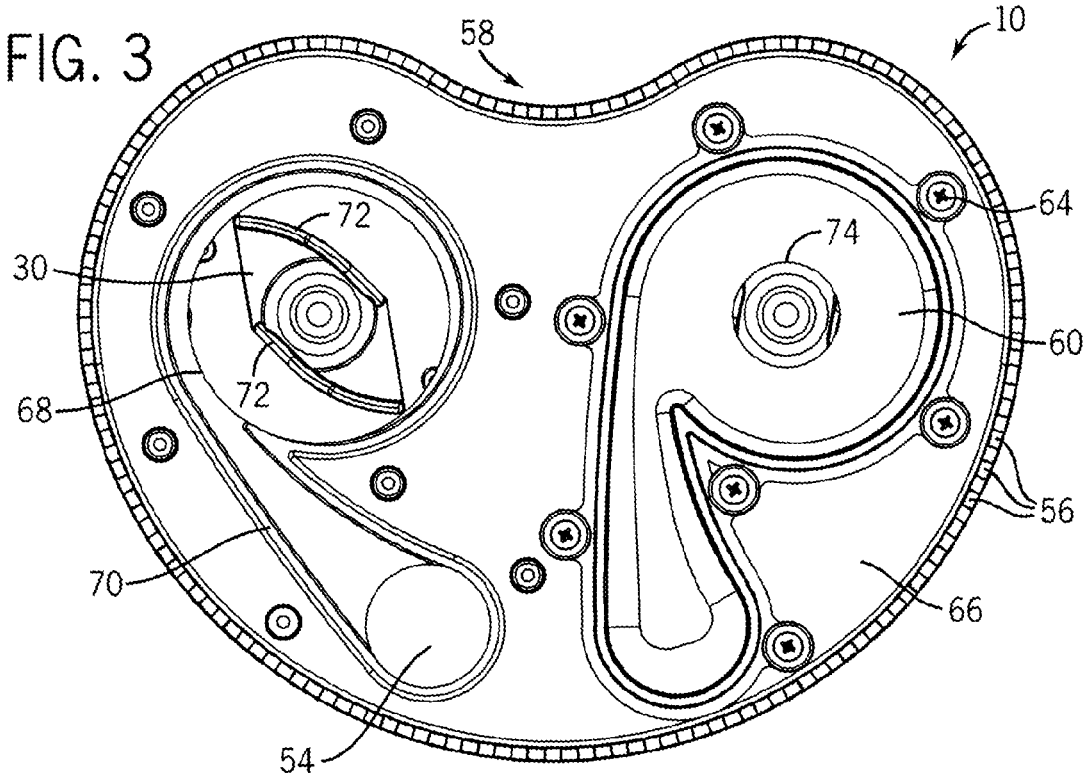
FIG. 3 is a bottom view of the sump pump system of FIG. 1 with a collector removed.

FIG. 3 illustrates the bottom of the sump pump system 10 according to one embodiment of the invention with the second collector 62 removed. The sidewall 52 can enclose an inner surface 66 of the base 12. In some embodiments, the first collector 60 and/or the second collector 62 can be coupled to the inner surface 66. In some embodiments, the base 12 can include a through hole 68 and a contoured passage 70. The through hole 68 can be sized to receive the impeller 30 through the base 12. As a result, the impeller 30 can remain attached to the first cartridge 14 or the second cartridge 16 during installation and/or removal. The first cartridge 14 and/or the second cartridge 16 can be coupled to an outer surface of the base 12, while the impeller 30 can be positioned adjacent to the inner surface 66.

In some embodiments, the shape of the contoured passage 70 can correspond to the shape of the first collector 60 and/or the second collector 62. The contoured passage 70 can help seal the connection between each collector 60, 62 and the base 12. In some embodiments, the contoured passage 70 can enclose the outlet 54. In one embodiment, as shown in FIG. 3, the base 12 can be kidney-shaped.

In some embodiments, as shown in FIGS. 2 and 3, the impeller 30 can include two or more blades 72. The blades 72 can help draw the fluid through an aperture 74, which can be located on each one of the first collector 60 and the second collector 62. In some embodiments, the aperture 74 can be centrally aligned with the shaft 40 (as shown in FIG. 2). The fluid entering the sump pump system 10 through the inlet 58 can flow into either the first collector 60 or the second collector 62 through the aperture 74 before being routed to the outlet 54.

Figure 4:
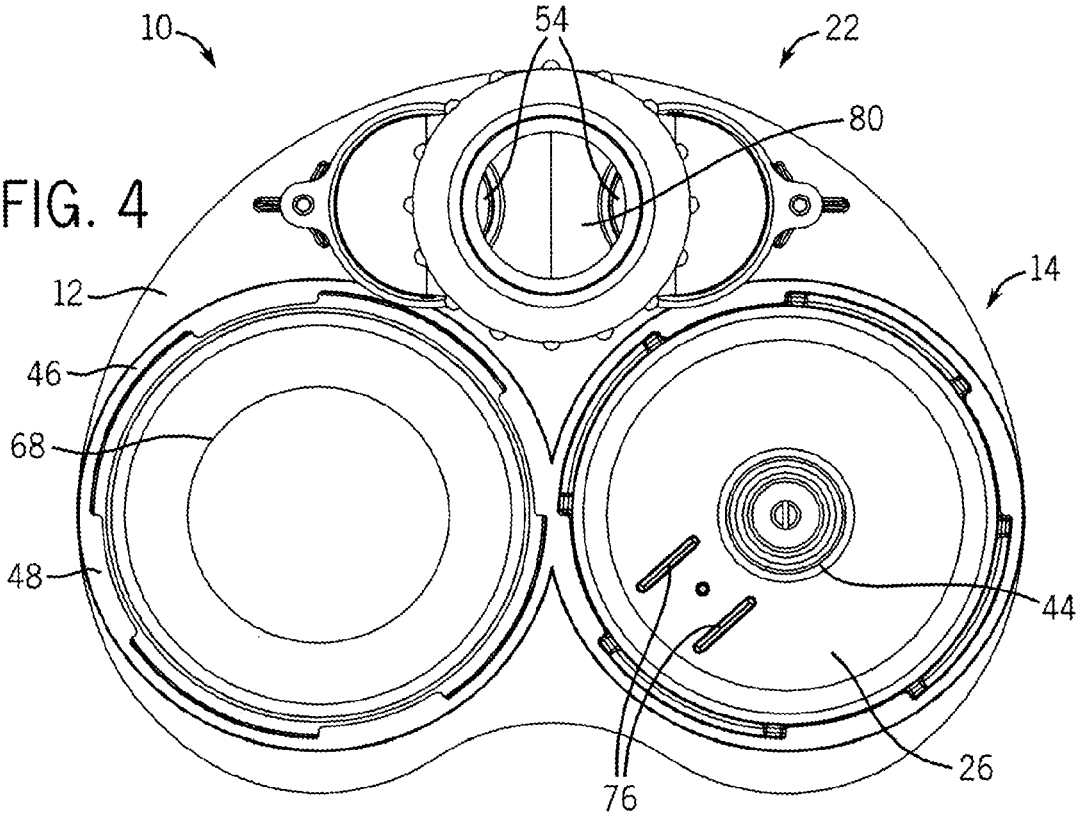
FIG. 4 is a top view of the sump pump system of FIG. 1 with a cartridge removed.

FIG. 4 illustrates the top of the sump pump system 10 according to one embodiment of the invention with the second cartridge 16 removed. The housing 26 can include rails 76 or other suitable fixtures to allow attachment of the first float switch 20 and/or the second float switch 34. In some embodiments, the outlet conduit system 22 can merge flow from the outlets 54 into a common outlet 80.

Figure 5A:
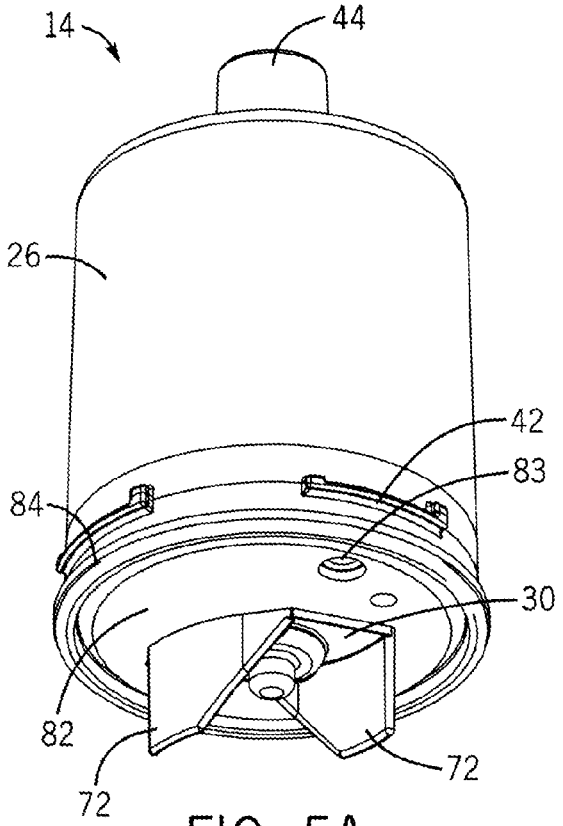
FIG. 5A is a perspective bottom view of a cartridge according to one embodiment of the invention.
Figure 5B:
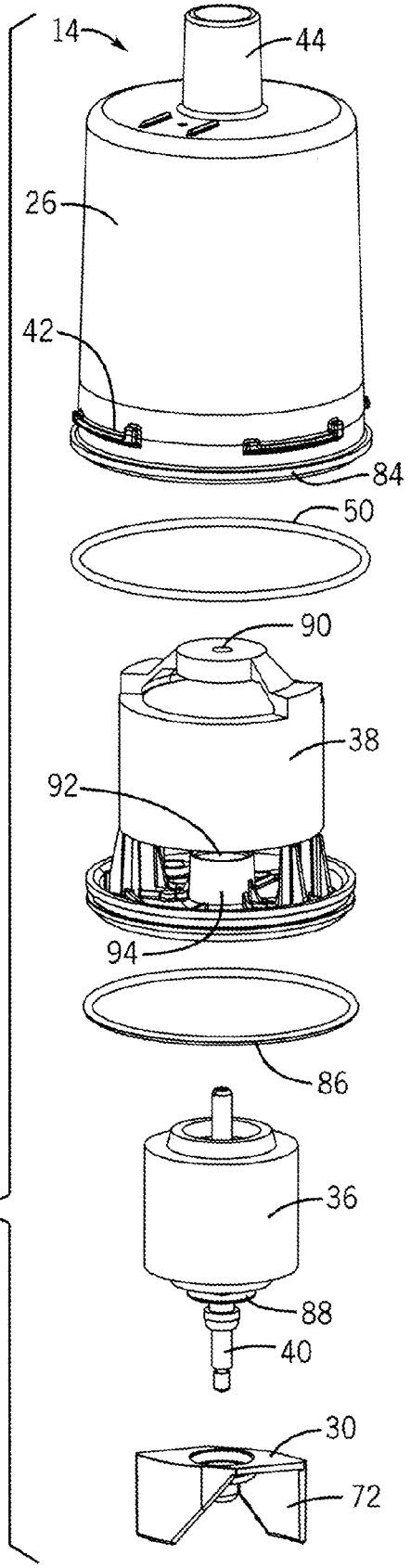
FIG. 5B is an exploded view of the cartridge of FIG. 5A.

FIG. 5A illustrates the bottom of the first cartridge 14 and/or the second cartridge 16 according to one embodiment of the invention. In some embodiments, the first cartridge 14 and the second cartridge 16 can each include the housing 26, the impeller 30, and a bottom plate 82. The bottom plate 82 can at as a lid for the housing 26. In some embodiments, the housing 26 can include a fluid (e.g., oil or other lubricants). The housing 26 can be filled with the fluid through a filler hole 83. In some embodiments, the housing 26 can include the latch 42, the protrusion 44, and a groove 84. The O-ring 50 (as shown in FIG. 5B) can be coupled to the housing 26 using the groove 84. The electric motor 28 can be enclosed by the housing 26 and the bottom plate 82. In some embodiments, the impeller 30 can be positioned adjacent to the bottom plate 82.

In some embodiments, the first cartridge 14 and the second cartridge 16 can be substantially identical. In other embodiments, the first cartridge 14 and the second cartridge 16 can include different sizes or types of electric motors 28. In one embodiment, the first cartridge 14 can include an AC electric motor and the second cartridge 16 can include a DC electric motor. Accordingly, in some embodiments, the first cartridge 14 can be powered by an alternating current (AC) power source and the second cartridge 16 can be powered by a direct current (DC) power source. For example, the first cartridge 14 can be powered by a building or mains power supply and the second cartridge 16 can be powered by a battery. If the mains power is lost, the second cartridge 16 can be activated.

In some embodiments, each electric motor 28 of the sump pump system 10 can be less powerful and/or consume less energy than a conventional sump pump including a single motor. While a conventional sump pump with a single motor must be designed to fulfill the expected highest flow rate, the electric motors 28 can be designed to pump an expected average flow rate. As a result, the electric motors 28 can be more compact, generate less heat, and/or can draw less current from the power source. In some embodiments, only if the expected average flow rate is exceeded, will the first cartridge 14 and the second cartridge 16 operate at the same time in order to satisfy the higher flow demand.

FIG. 5B illustrates the internal components of the first cartridge 14 and/or the second cartridge 16 according to one embodiment of the invention. Each one of the first cartridge 14 and the second cartridge 16 can include the housing 26, the O-ring 50, the stator 38, the bottom plate 82 (as shown in FIG. 5A), the rotor 36, the shaft 40, and the impeller 30. The first cartridge 14 and the second cartridge 16 can each further include a gasket 86 and a seal 88. The stator 38 can be coupled to the bottom plate 82. The stator 38 can include a hole 90, which can receive the shaft 40. In some embodiments, the hole 90 can serve as a bearing for the rotor 36. The gasket 86 can seal the housing 26 to the bottom plate 82. In some embodiments, friction between the gasket 86 and the housing 26 can hold the bottom plate 82 in position.

The bottom plate 82 can include an opening 92 and a cylinder 94. The cylinder 94 can hold the rotor 36 in position with respect to the stator 38. In some embodiments, the cylinder 94 can house a bearing for the shaft 40. The shaft 40 can extend through the opening 92 and the seal 88 can make the connection between the shaft 40 and the bottom plate 82 waterproof. The impeller 30 can be coupled to the shaft 40, which can extend beyond the bottom plate 82.

In some embodiments, the sump pump system 10 can include an automatic plug and pump feature. The first cartridge 14 and/or the second cartridge 16 can be replaced without removing any piping or disassembling the sump pump system 10. In some embodiments, the quick connect device 24 can facilitate the installation and/or the removal of the first cartridge 14 or the second cartridge 16. For example, if the first cartridge 14 is not operating, the quick connect device 24 can be used to disengage and the first cartridge 14 together with the first float switch 20 (which can be attached to the first cartridge 14 by the rail 76) can be removed from the sump pump system 10. The first float switch 20 can be reattached to the new "cartridge" before installing the new cartridge as the first cartridge 14 on the sump pump system 10. As a result, the downtime of the sump pump system 10 before the sump pump system 10 can be put back into service after a breakdown can be substantially reduced.

Figure 6:
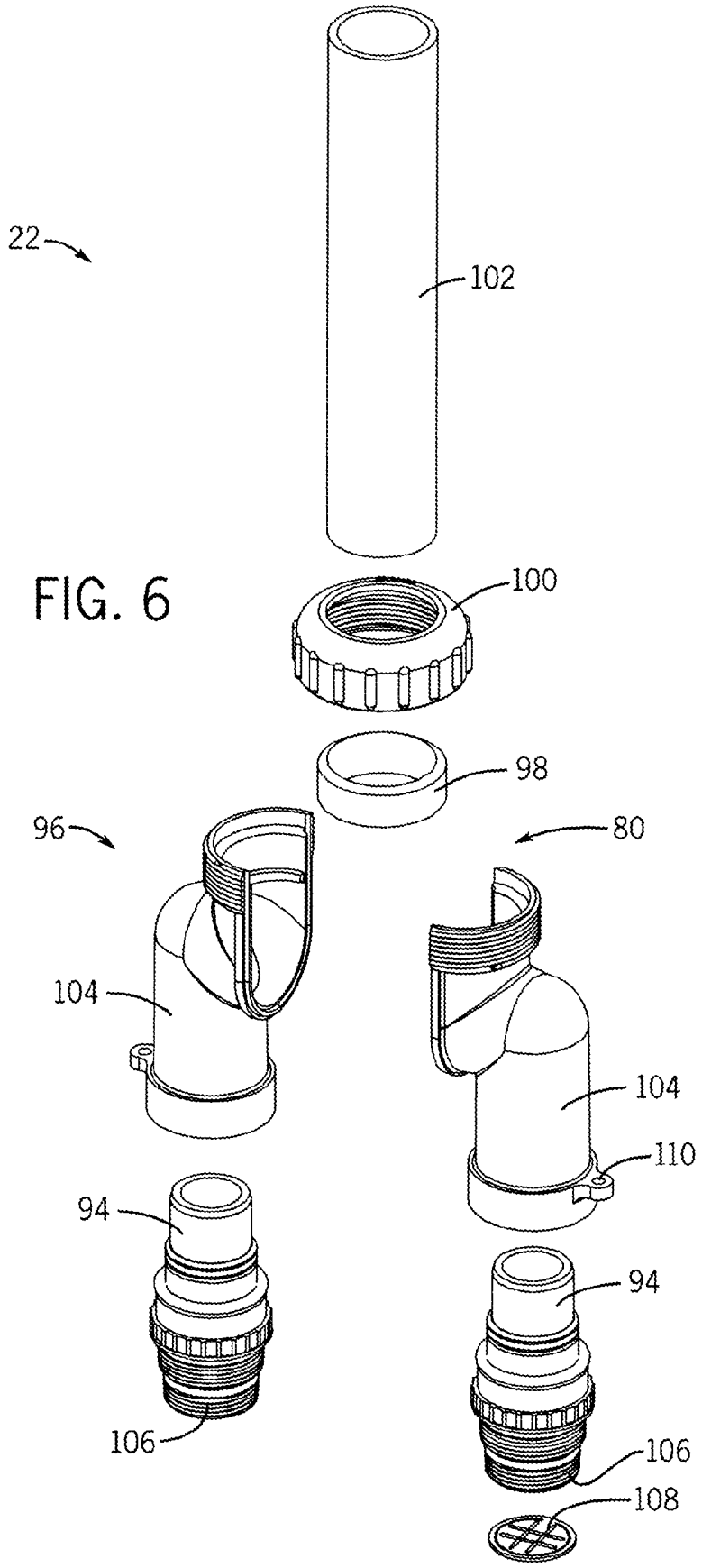
FIG. 6 is an exploded view of an outlet conduit system according to one embodiment of the invention.

FIG. 6 illustrates the outlet conduit system 22 according to one embodiment of the invention. The outlet conduit system 22 can include adapters 94, a junction 96, a ring seal 98, a cap 100, and a pipe 102. The junction 96 can include pipe sections 104. In some embodiments, one adapter 94 and one pipe section 104 are provided for each outlet 54. The junction 96 can merge the fluid from the outlets 54 into the common outlet 80.

In some embodiments, the adapters 94 can include threads 106 and a flow restrictor 108. The threads 106 can be used to couple the adapters 94 to the base 12. The flow restrictor 108 can prevent a fluid from exiting the outlet conduit system 22 through the outlets 54. In some embodiments, the flow restrictor 108 can prevent fluid flow from one of the outlets 54 to another. In some embodiments, the flow restrictor 108 can help direct fluid flow toward the common outlet 80.

In some embodiments, the junction 96 can be manufactured as an integral part. The junction 96 can include an eye 110. In some embodiments, the adapters 94 can be screwed into the base 12 and the junction 96 can be plugged onto the adapters 94. The eye 110 can be used to couple the junction 96 to the base 12 with a fastener. The pipe 102 can be coupled to the junction 96 with the ring seal 98 and the cap 100. The pipe 102 can be part of an outlet piping system routing the pumped fluid away from the sump pump system 10.

Figure 7:
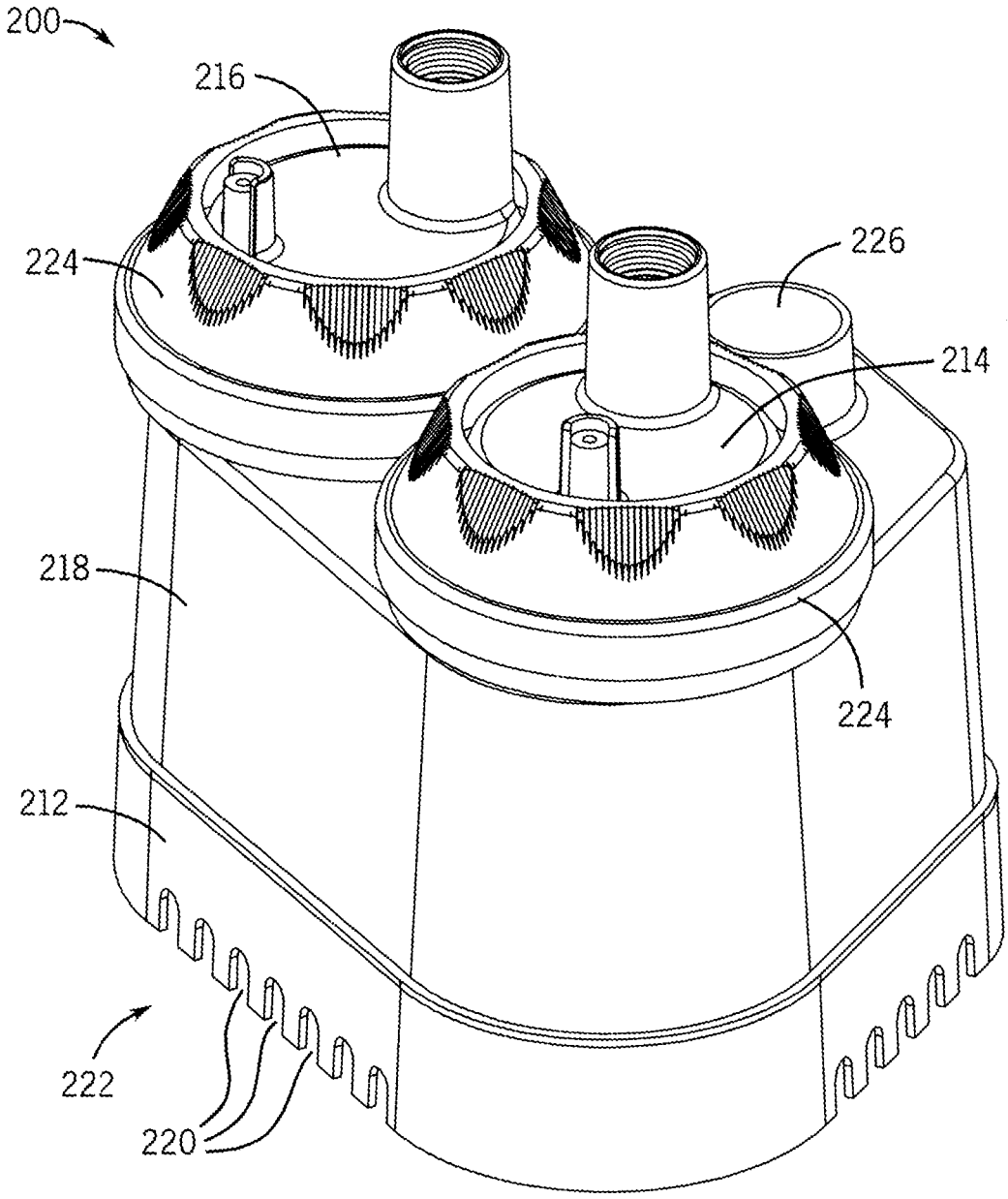
FIG. 7 is a perspective view of a sump pump system according to another embodiment of the invention.

FIG. 7 illustrates a sump pump system 200 according to another embodiment of the invention. The sump pump system 200 can include a base 212, a first cartridge 214, a second cartridge 216, and a cover 218. The base 212 can include openings 220, which can act as an inflow 222 to the sump pump system 200. In some embodiments, the openings 220 can be positioned along a substantially straight portion of the base 212.

In some embodiments, the cover 218 can engage the base 212 to form an enclosure. The first cartridge 214 and the second cartridge 216 can be positioned inside the enclosure. In some embodiments, the first cartridge 214 and the second cartridge 216 can each be coupled to the cover 218 using a nut 224. In some embodiments, the cover 218 can include a common outlet 226.

Figure 8:
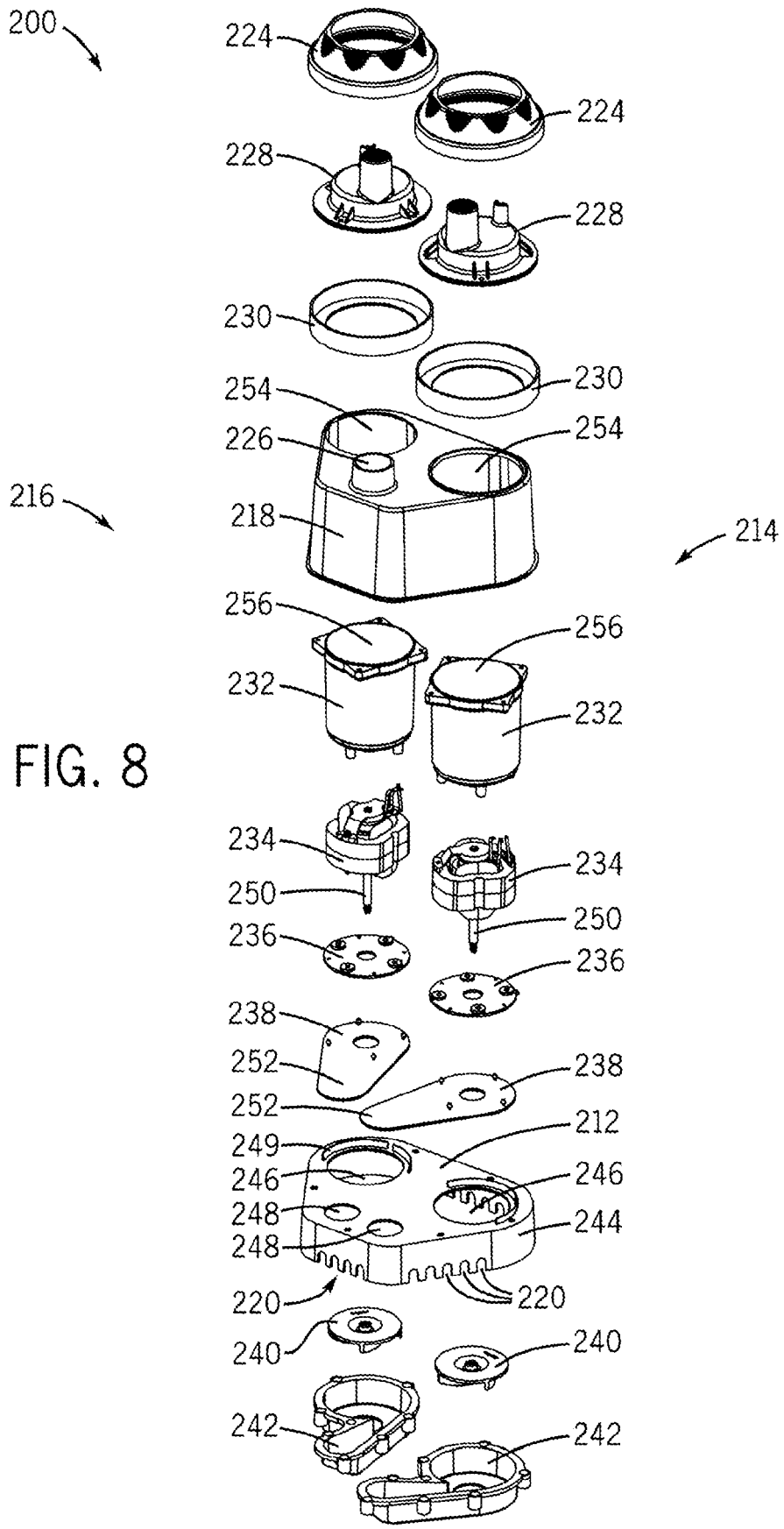
FIG. 8 is an exploded view of the sump pump system of FIG. 7.

FIG. 8 illustrates the internal components of the sump pump system 200 according to one embodiment of the invention. In some embodiments, each one of the first cartridge 214 and the second cartridge 216 can include a lid 228, a gland 230, a housing 232, an electric motor 234, a disc 236, a gasket 238, an impeller 240, and a collector 242. The base 212 can include a sidewall 244, apertures 246, and outlets 248. Each aperture 246 can be sized to receive one of the impellers 240. In some embodiments, the base 212 can include ridges 249, each of which can be positioned adjacent to each aperture 246. In some embodiments, the ridge 249 can help align the first cartridge 214 and/or the second cartridge 216 onto the base 212.

In some embodiments, the first cartridge 214 and the second cartridge 216 can each include the lid 228, the housing 232, the electric motor 234, the disc 236, the gasket 238, and the impeller 240. The housing 232 can enclose the electric motor 234. A shaft 250 of the electric motor 234 can be received by the housing 232. The shaft 250 can extend through the housing 232, the disc 236, the gasket 238, and the base 212. The impeller 240 can be coupled to the shaft 250. In some embodiments, the gasket 238 can include a flap 252. In some embodiments, the flap 252 can extend substantially outward and can at least partially cover one of the outlets 248.

In some embodiments, the first cartridge 214 can be activated to pump the fluid. The impeller 240 of the first cartridge 214 can draw the fluid through the inflow 222 into the collector 242, which can route the fluid toward the outlet 248. The flap 252 can bend upward enabling the fluid to fill the enclosure inside the cover 218. The first cartridge 214 and the second cartridge 216 can come into contact with the pumped fluid. If the second cartridge 216 is not activated, the flap 252 for the second cartridge 216 can prevent the fluid from leaving the enclosure so that the enclosure can be filled with the fluid until the common outlet 226 is reached. Additional conduits can be attached to the common outlet 226 in order to route the fluid to a desired location.

In some embodiments, the first cartridge 214 and/or the second cartridge 216 can be coupled to the cover 218. Each gland 230 can be aligned with an aperture 254 of the cover 218 and can be fixedly coupled to the cover 218. In some embodiments, the gland 230 can be welded to the cover 218. Each housing 232 can be inserted through one gland 230 and one aperture 254. Each housing 232 can be substantially sealed except for an upper portion 256. Each lid 228 can be coupled to the upper portion 256 of each housing 232 and/or each gland 230. In some embodiments, the gland 230 can be threaded to engage the nut 224 in order to couple the first cartridge 214 or the second cartridge 216 to the sump pump system 200. In some embodiments, tightening the nut 224 can seal the upper portion 256 with respect to the lid 228 and/or the gland 230.

Figure 9:
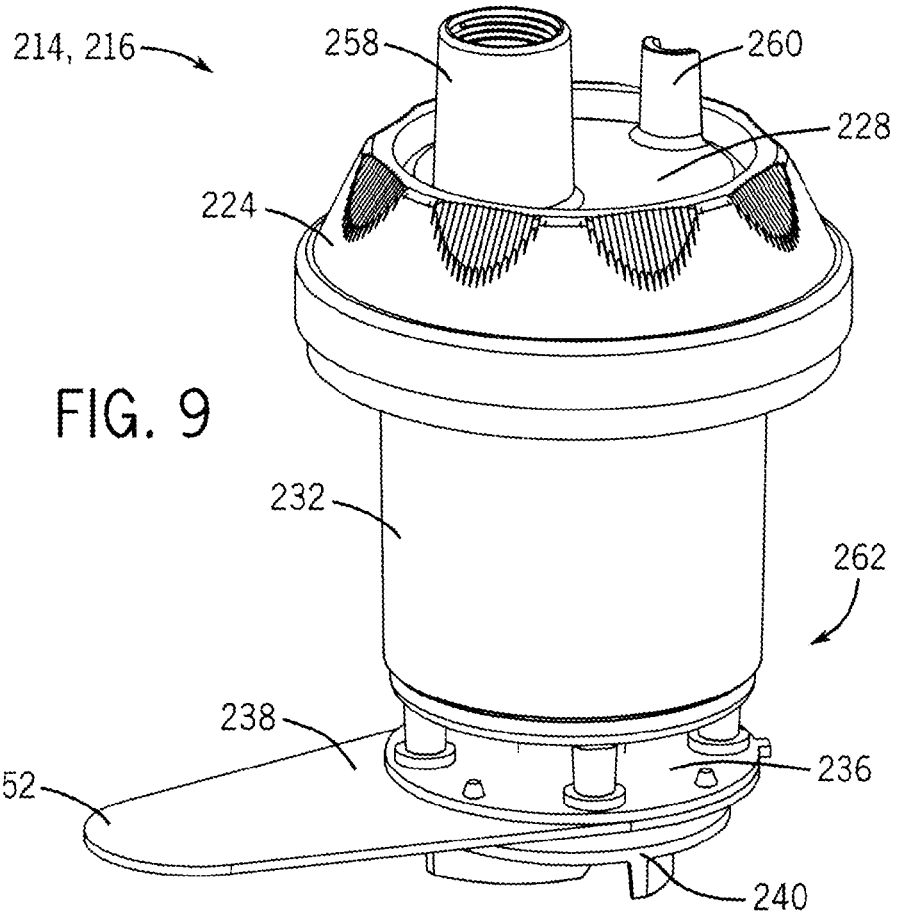
FIG. 9 is a perspective view of a cartridge for use with the sump pump system of FIG. 7.

FIG. 9 illustrates the first cartridge 214 and/or the second cartridge 216 according to one embodiment of the invention. The first cartridge 214 and the second cartridge 216 can each include the lid 228, the nut 224, the housing 232, the disc 236, the gasket 238, and the impeller 240. The lid 228 can include a protrusion 258, which, in some embodiments, can be internally threaded. In some embodiments, the lid 228 can further include a projection 260. The projection 260 can be used to couple the first float switch 20 and/or the second float switch 34 to the first cartridge 214 and/or the second cartridge 216.

In some embodiments, the disc 236 and the gasket 238 can be coupled to a lower portion 262 of the housing 232. In some embodiments, the disc 236 can be larger than the aperture 246 (as shown in FIG. 8) of the base 212 to support the gasket 238 in order to seal the base 212 to the first cartridge 214 or the second cartridge 216. In some embodiments, the disc 236 can prevent leaking between the base 212 and the cartridge 214, 216 even if the flap 252 is moving (e.g., bending upward and/or downward).

Figure 10:
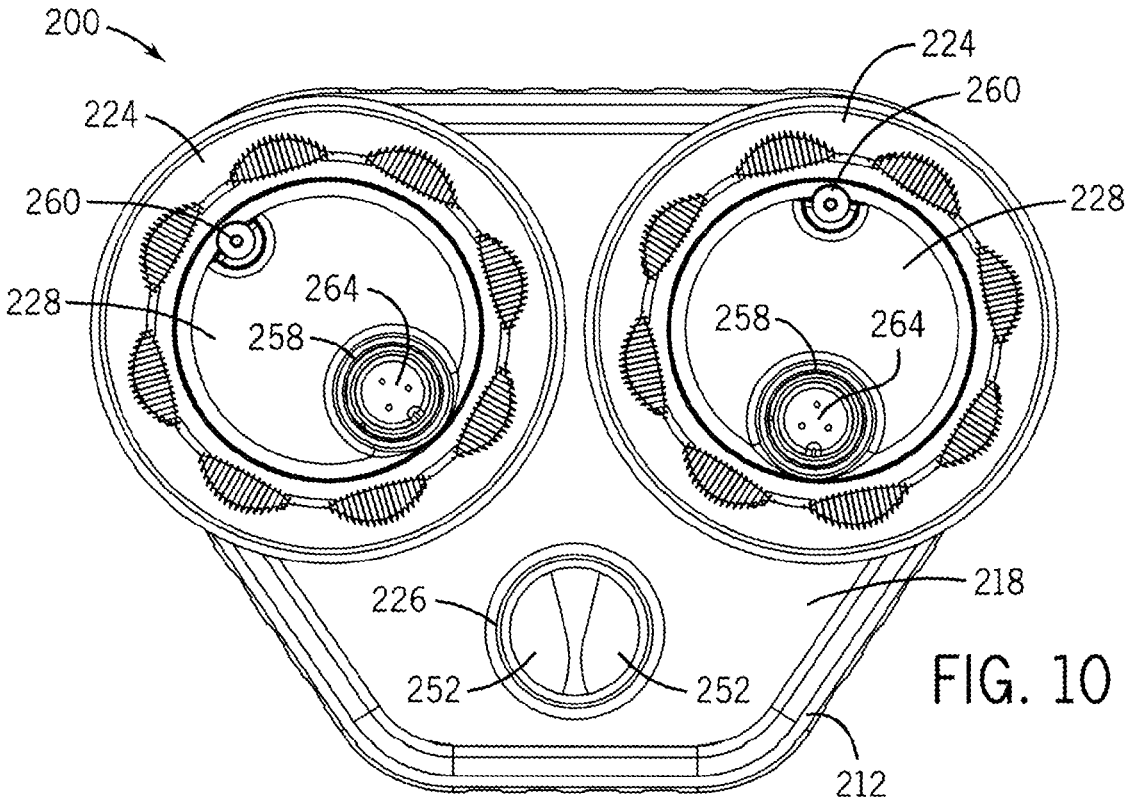
FIG. 10 is a top view of the sump pump system of FIG. 7.

FIG. 10 is the top of an assembled sump pump system 200 according to one embodiment of the invention. The lids 228 can each include an electrical connector 264 to supply power to each electric motor 234. In some embodiments, the electrical connector 264 can be positioned within the protrusion 258 to which the second power cord 33 can be coupled. In some embodiments, the protrusion 258 can be used to protect the electrical connector 264 from fluid.

In some embodiments, the first cartridge 214 and the second cartridge 216 can each be associated with one outlet 248. The fluid pumped by the sump pump system 200 coming from one outlet 248 can bend one flap 252 upward so that fluid can pass into the enclosure formed by the base 212 and the cover 218. In some embodiments, the other flap 252 can help prevent fluid from exiting the enclosure through the other outlet 248. As a result, the flaps 252 can help direct fluid flow from each outlet 248 to the common outlet 226. In some embodiments, a piping system from the outlets 248 to the common outlet 226 may not be necessary.

Figure 11:
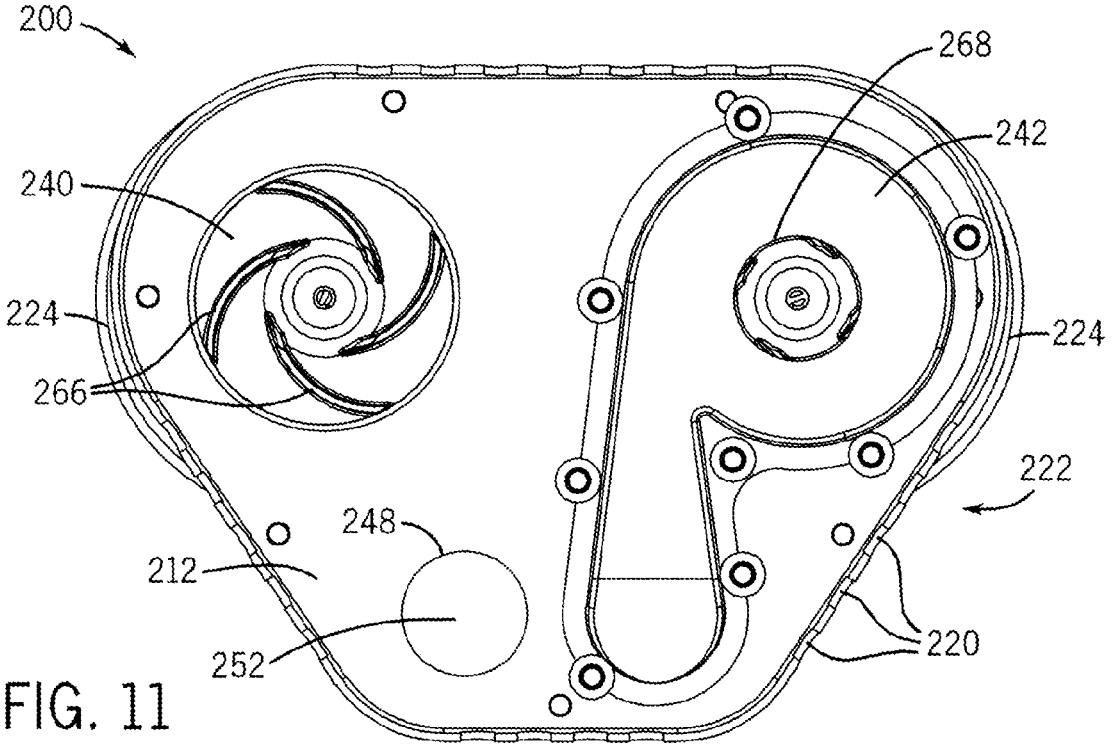
FIG. 11 is a bottom view of the sump pump system of FIG. 7 with a collector removed.

FIG. 11 illustrates the bottom of the sump pump system 200 according to one embodiment of the invention with one of the collectors 242 removed. The impeller 240 can include blades 266. The collector 242 can include an aperture 268. In some embodiments, the aperture 268 can be in fluid communication with the inflow 222 and one outlet 248.

Figure 12:
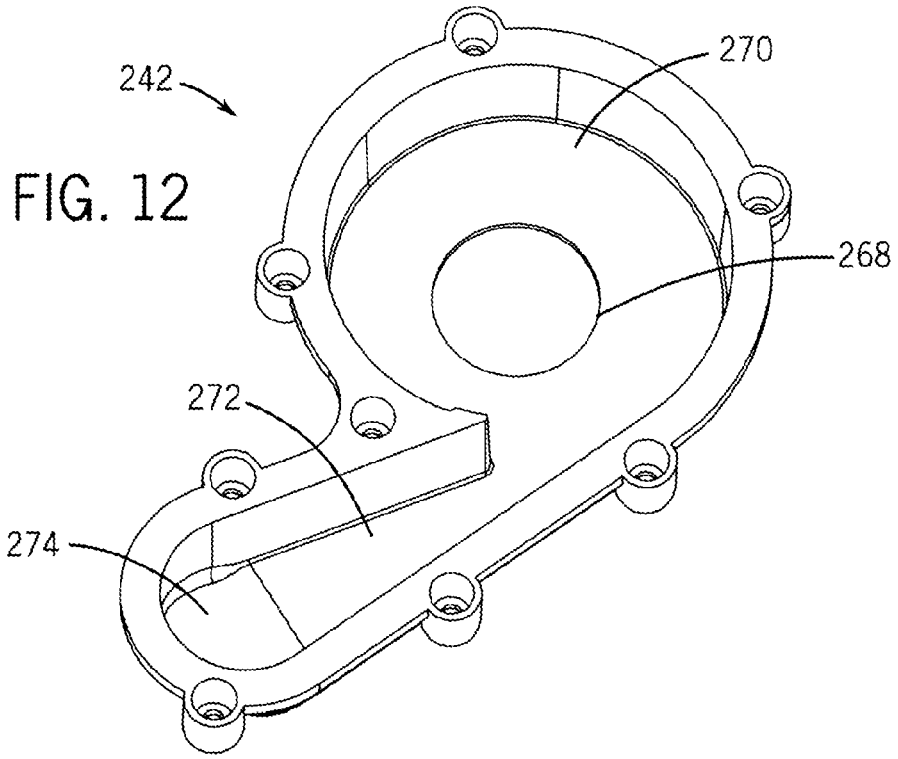
FIG. 12 is a perspective view of a collector according to one embodiment of the invention.

FIG. 12 illustrates a collector 242 according to one embodiment of the invention. The collector 242 can include a chamber 270, which can be sized to enclose the impeller 240. The chamber 270 can be in fluid communication with a channel 272, which can enable fluid communication between the aperture 268 and the outlet 248. In some embodiments, the channel 272 can include a sloped portion 274. The sloped portion 274 can increase the volume of the channel 272 adjacent to the outlet 248. As a result, the sloped portion 274 can direct fluid flow toward the outlet 248. In other embodiments, the sloped portion 274 can decrease a volume of the channel 272 in order to direct the fluid toward the outlet 248. In some embodiments, the slope 272 can be curved.

In some embodiments, the collector 242 can be coupled to a bottom portion of the base 212. As shown in FIG. 8, the sidewall 244 can surround the base 212 forming a compartment in which the collectors 242 can be positioned. The sidewall 244 can be high enough to enable the sump pump system 200 to engage with the ground without the collectors 242 coming into contact with the ground. The collectors 242 can enclose the impellers 240. In some embodiments, the channel 272 of one collector 242 can merge with the channel 272 of another collector 242 forming the common outlet 226 (as shown in FIG. 10). The common outlet 226 can be in fluid communication with the outlets 248 to which additional piping can connect. In some embodiments, the cover 218 may not be included in the sump pump system 200 and/or the flaps 252 can be detached from the gasket 238. In some embodiments, the flaps 252 can be coupled to the base 212 and/or the collectors 242 adjacent to the common outlet 226. In some embodiments, the flaps 252 can rotate with respect to the base 212 and/or the collectors 242.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A sump pump system that pumps fluid, the sump pump system comprising:

a base including a first through hole and a second through hole, and at least one fluid inlet and at least one fluid outlet;

a first cartridge extending into the first through hole and mechanically coupled to the base, the first cartridge removable from the base, the first cartridge including a first electric motor;

a second cartridge extending into the second through hole and mechanically coupled to the base, the second cartridge removable from the base, the second cartridge including a second electric motor;

at least one flexible gasket including a flexible flap portion, a portion of the at least one flexible gasket coupled to at least one of the first cartridge, the second cartridge, and the base with the flexible flap portion extending away from the at least one of the first cartridge and the second cartridge and at least partially covering the at least one fluid outlet; and at least one of the first cartridge and the second cartridge being capable of operating at any given time in order to propel fluid from the at least one fluid inlet, through the base, and to the at least one fluid outlet.

2. The sump pump system of claim 1, and further comprising at least one float switch; and wherein at least one of the first cartridge and the second cartridge is activated based on a fluid level monitored by the at least one float switch.

3. The sump pump system of claim 1, wherein the first electric motor is powered by a direct current power source and the second electric motor is powered by an alternating current power source.

4. The sump pump system of claim 3, wherein the direct current power source is a battery.

5. The sump pump system of claim 3, wherein the alternating current power source is a mains power supply.

6. The sump pump system of claim 1, and further comprising at least one flap positioned adjacent to the at least one outlet.

7. The sump pump system of claim 1, and further comprising at least one collector positioned adjacent to the at least one outlet.

8. The sump pump system of claim 7, wherein the at least one collector includes an aperture enabling a fluid to enter the at least one collector.

9. The sump pump system of claim 8, wherein the aperture is aligned with a shaft of one of the first electric motor and the second electric motor.

10. The sump pump system of claim 1, wherein the first cartridge includes a first impeller driven by the first electric motor and the second cartridge includes a second impeller driven by the second electric motor.

11. The sump pump system of claim 1, wherein at least one of the first cartridge and the second cartridge is mechanically coupled to the base using a quick connect device.

12. The sump pump system of claim 1, and further including an outlet conduit system coupleable to the at least one outlet.

13. A sump pump system that pumps fluid, the sump pump system comprising:

a base including at least one inlet and at least one outlet;

a first sealed cartridge removably coupled to the base, the first sealed cartridge including a first electric motor and a first impeller extending from the first sealed cartridge;

a second sealed cartridge removably coupled to the base, the second sealed cartridge including a second electric motor and a second impeller extending from the second sealed cartridge;

a power supply in electrical communication with the first electric motor and the second electric motor;

at least one flexible gasket including a flexible flap portion, a portion of the at least one flexible gasket coupled to at least one of the first sealed cartridge and the second sealed cartridge, with the flexible flap portion extending away from the at least one of the first sealed cartridge and the second sealed cartridge and at least partially covering the at least one outlet; and each of the first sealed cartridge and the second sealed cartridge being removable from the base without the use of tools and using a quick connect device, each of the first sealed cartridge and the second sealed cartridge being removable from the base without interrupting the electrical communication between the power supply and each of the first electric motor and the second electric motor.

14. The sump pump system of claim 13, wherein the power supply includes a float switch.

15. The sump pump system of claim 13, wherein the base includes a through hole sized to receive the impeller.

16. A sump pump system that pumps fluid, the sump pump system comprising:

a base including at least one outlet;

a sealed cartridge coupled to the base, the sealed cartridge including an electric motor and an impeller extending from the sealed cartridge; and a flexible gasket including a flexible flap portion, a portion of the flexible gasket coupled to the cartridge, with the flexible flap portion extending away from the cartridge and at least partially covering the at least one outlet.

17. The sump pump system of claim 16, and further comprising at least one collector in fluid communication with one of the at least one outlet.

18. The sump pump system of claim 17, wherein the at least one collector includes a slope.

19. The sump pump system of claim 18, wherein the slope directs fluid from the at least one collector to the at least one outlet.

20. The sump pump system of claim 16, wherein the base includes a through hole sized to receive the impeller.

21. The sump pump system of claim 16, wherein the cartridge is coupled to the base using a quick connect device.

* * * * *